US011020929B2

(12) United States Patent
Takemoto et al.

(10) Patent No.: US 11,020,929 B2
(45) Date of Patent: Jun. 1, 2021

(54) CORRUGATED BOARD WEB CUTTING DEVICE AND CORRUGATED BOARD MANUFACTURING DEVICE

(71) Applicant: MITSUBISHI HEAVY INDUSTRIES MACHINERY SYSTEMS, LTD., Kobe (JP)

(72) Inventors: Shuichi Takemoto, Mihara (JP); Naoyuki Fukushige, Mihara (JP)

(73) Assignee: MITSUBISHI HEAVY INDUSTRIES MACHINERY SYSTEMS, LTD., Kobe (JP)

( * ) Notice: Subject to any disclaimer, the term of this patent is extended or adjusted under 35 U.S.C. 154(b) by 0 days.

(21) Appl. No.: 16/484,524

(22) PCT Filed: Feb. 21, 2018

(86) PCT No.: PCT/JP2018/006287

§ 371 (c)(1),
(2) Date: Aug. 8, 2019

(87) PCT Pub. No.: WO2018/155507

PCT Pub. Date: Aug. 30, 2018

(65) Prior Publication Data

US 2020/0031082 A1 Jan. 30, 2020

(30) Foreign Application Priority Data

Feb. 24, 2017 (JP) ..... JP2017-033418

(51) Int. Cl.
*B31B 50/18* (2017.01)
*B31B 50/20* (2017.01)
*B31B 50/00* (2017.01)

(52) U.S. Cl.
CPC ..... *B31B 50/18* (2017.08); *B31B 50/006* (2017.08); *B31B 50/20* (2017.08)

(58) Field of Classification Search
CPC ..... B31B 50/18; B31B 50/20; B31B 50/006
See application file for complete search history.

(56) References Cited

U.S. PATENT DOCUMENTS 5,165,314 A * 11/1992 Paulson ..... B26D 1/24 493/370
5,496,431 A 3/1996 Hirakawa et al.
(Continued)

FOREIGN PATENT DOCUMENTS

EP 0737553 A1 10/1996
EP 0999040 A1 5/2000
(Continued)

OTHER PUBLICATIONS

Europe Patent Office, "Extended European Search Report for European Patent Application No. 1875802.1," dated Dec. 18, 2019.
(Continued)

*Primary Examiner* — Omar Flores Sanchez
(74) *Attorney, Agent, or Firm* — Manabu Kanesaka; Benjamin Hauptman; Kenneth Berner

(57) ABSTRACT

The present invention is provided with: one slitter device which forms cutting lines on a corrugated board web in a conveying direction and produces a plurality of slitted webs; a plurality of cutoff devices which cut the slitted webs in the width direction; a director device which separates the plurality of slitted webs cut by the slitter device and distributes same to the plurality of cutoff devices; and a separation cutting device which is disposed on the upstream side of the director device, and forms separation cutting lines, which are for separating the plurality of slitted webs with the director device, between the slitted webs of a new order and an old order, wherein the cutting operation is continued after the separation cutting device is stopped at the position of a separation cutting line of the new order.

6 Claims, 7 Drawing Sheets

(56) References Cited

U.S. PATENT DOCUMENTS 5,951,454 A * 9/1999 Adami ..... B26D 5/02 493/355
6,139,482 A * 10/2000 Lafleur ..... B65D 88/1612 493/210
6,209,291 B1 * 4/2001 Deien ..... B31B 50/00 493/194
6,254,521 B1 * 7/2001 Pansier ..... B65D 31/08 493/194
7,470,062 B2 * 12/2008 Moteki ..... B65B 61/18 229/87.05
8,312,798 B2 * 11/2012 Kwarta ..... B41J 11/68 83/425.3
8,579,777 B2 * 11/2013 Hatano ..... B31B 50/00 493/56
2003/0037646 A1 2/2003 Ito et al.
2006/0086217 A1 4/2006 Titz
2008/0085823 A1 * 4/2008 Reggi ..... B31B 70/00 493/189
2009/0120263 A1 * 5/2009 Suzuki ..... B26D 3/20 83/865
2012/0216662 A1 * 8/2012 Yamada ..... B26F 1/384 83/331
2014/0326119 A1 * 11/2014 Endoh ..... B26F 1/12 83/301
2015/0148210 A1 * 5/2015 Sibthorpe ..... B41J 3/407 493/324
2018/0104923 A1 * 4/2018 Totani ..... B31B 50/18
2018/0345619 A1 * 12/2018 Lang ..... B65H 35/02
2018/0370061 A1 * 12/2018 Tokumo ..... B26D 1/285

FOREIGN PATENT DOCUMENTS

EP 1652639 A1 5/2006
EP 1790442 A1 5/2007
JP H09-248788 A 9/1997
JP H10-278131 A 10/1998
JP 2000-135696 A 5/2000
JP 3396245 B2 4/2003
JP 2016-187841 A 11/2016

OTHER PUBLICATIONS

China Patent Office, "Office Action for Chinese Patent Application No. 201880012160.4," dated Jun. 17, 2020.
Korea Patent Office, "Office Action for Korean Patent Application No. 2019-7023330," dated Aug. 19, 2020.

* cited by examiner

CORRUGATED BOARD WEB CUTTING DEVICE AND CORRUGATED BOARD MANUFACTURING DEVICE

RELATED APPLICATIONS

The present application is National Phase of International Application No. PCT/JP2018/006287 filed Feb. 21, 2018, and claims priority from Japanese Application No. 2017-033418, filed Feb. 24, 2017, the disclosure of which is hereby incorporated by reference herein in its entirety.

TECHNICAL FIELD

The present invention relates to a corrugated board web cutting device and a corrugated board manufacturing device.

BACKGROUND ART

PTL 1 discloses a corrugating machine capable of manufacturing two types of corrugated board webs at a time. Hereinafter, the corrugating machine disclosed in PTL 1 will be described using reference numerals used in PTL 1 and shown in parentheses for reference.

The corrugating machine disclosed in PTL 1 includes a cutting device (4), slitter scorers (1*a*, 1*b*), and cutoffs (22*a*, 22*b*). A plurality of slitted webs (5) formed in the slitter scorers (1*a*, 1*b*) are separated and conveyed to the cutoffs (22*a*, 22*b*), and corrugated boards having different sizes can be manufactured simultaneously. Further, in an order change, separation cutting lines formed so as to be capable of being separated and conveyed to the plurality of cutoffs (22*a*, 22*b*) in the slitter scorers (1*a*, 1*b*) are different in position in a width direction between an old order and a new order, and therefore, the cutting device (4) performs cutting so as to make the separation cutting lines continuous.

CITATION LIST

Patent Literature

[PTL 1] Japanese Unexamined Patent Application Publication No. 09-248788

SUMMARY OF INVENTION

Technical Problem

The corrugating machine disclosed in PTL1 is provided with the two slitter scorers (1*a*, 1*b*) which are switched and used each time an order is changed, and therefore, it is possible to promptly perform an order change. That is, in a waiting slitter scorer, a slitter knife and a creasing line roll which are in a state of being separated from a corrugated board web (3) are moved in advance to a position corresponding to the next order, and if an order change command is output from a production management device, the order change can be promptly completed merely by pressing the slitter knife and the creasing line roll in the separated state against the corrugated board web (3).

On the other hand, there is also a corrugating machine which is provided with only one slitter scorer for a reduction in the manufacturing cost or space saving of the corrugating machine, and a problem in this case will be described.

In a case where an order change is performed in only one slitter scorer, when an order change command is output, a slitter knife which has cut a corrugated board web at a position corresponding to an old order is temporarily separated from the corrugated board web and then moved to a predetermined position corresponding to a new order, and thereafter, the slitter knife is pressed against the corrugated board web. For this reason, compared to the case of using two slitter scorers, the number of operations which are required from the output of the order change command to the start of cutting increases, and an error of a cutting start position tends to become large.

The fact that the error of the cutting start position becomes large is that an error of a start position of the separation cutting line of the new order becomes large, and therefore, there is a concern that the separation cutting lines of the old order and the new order may not be made to be reliably continuous by the cutting device (4). Then, the slitted web (5) which is conveyed to the cutoff (22*a*) on one side and the slitted web (5) which is conveyed to the cutoff (22*b*) on the other side remain connected to each other to be torn at a separation position to the cutoffs (22*a*, 22*b*) or jammed up in a conveyance path.

The present invention has been made in view of the problem as described above and has an object to provide to a corrugated board web cutting device and a corrugated board manufacturing device, in which it is possible to prevent slitted webs which are conveyed to different cutoff devices from being torn or jammed up in a conveyance path.

Solution to Problem (1) In order to achieve the above object, a corrugated board web cutting device according to the present invention includes one slitter device which forms cutting lines in a corrugated board web along a transfer direction to create a plurality of slitted webs, a plurality of cutoff devices which cut the plurality of slitted webs along a width direction, a director device which is disposed between the slitter device and the plurality of cutoff devices to separate the plurality of slitted webs cut by the slitter device and distribute the slitted webs to the plurality of cutoff devices, a separation cutting device which is disposed further on the upstream side than the director device and forms separation cutting lines for separating the plurality of slitted webs in the director device, between the slitted web of a new order and the slitted web of an old order, and a control device which controls an operation of the separation cutting device so as to continue a cutting operation for a predetermined time or by a predetermined cutting length after a movement in the width direction is stopped at a position of the separation cutting line of the new order.

(2) It is preferable that the control device compares a first period which is required for the separation cutting device to move from the separation cutting line of the old order to the separation cutting line of the new order, with a second period which is required for the slitter device to be changed from setting for the old order to setting for the new order, and controls the slitter device such that the slitter device starts cutting after completion of a change to the setting for the new order, in a case where the first period is equal to or less than the second period.

(3) It is preferable that the control device compares a first period which is required for the separation cutting device to move from the separation cutting line of the old order to the separation cutting line of the new order, with a second period which is required for the slitter device to be changed from setting for the old order to setting for the new order, and controls the slitter device so as to start cutting by the slitter device after the separation cutting device moves to the separation cutting line of the new order, in a case where the first period exceeds the second period.

(4) In order to achieve the above object, a corrugated board manufacturing device according to the present invention includes the corrugated board web cutting device according to any one of the above (1) to (3).

Advantageous Effects of Invention

According to the present invention, the separation cutting device forms a cutting line along the transfer direction by continuing a cutting operation for a predetermined time or by a predetermined cutting length after the separation cutting device moves to the position in the width direction of the separation cutting line of the new order and then stops. In this way, even if an error occurs, in the transfer direction, at the start position of the separation cutting line of the new order, this error range can be covered.

Therefore, the separation cutting line of the new order and the separation cutting line of the old order can be made to be reliably continuous, and thus it is possible to prevent the slitted webs which are conveyed to different cutoff devices from being torn or jammed up in a conveyance path.

DESCRIPTION OF EMBODIMENTS

Figure 1:
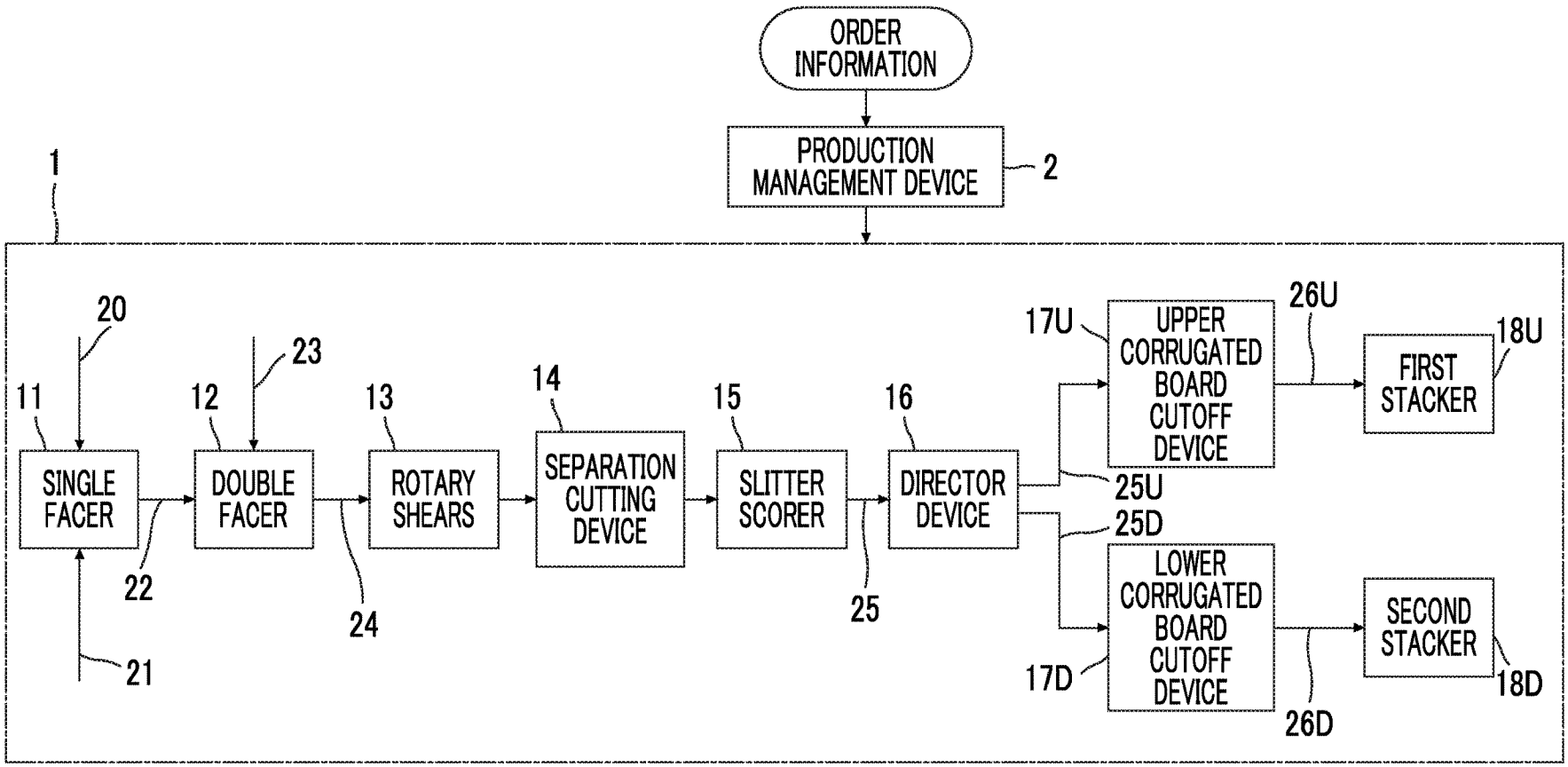
FIG. 1 is a schematic diagram showing an overall configuration of a corrugated board manufacturing system according to each embodiment of the present invention.

Hereinafter, embodiments of the present invention will be described with reference to the drawings.

In the following description, a direction in which a corrugated board web is conveyed is referred to as a transfer direction, the right and left are defined on the basis of the transfer direction, a direction of gravity is described as being a downward direction, and the opposite direction thereto is described as being an upward direction.

Further, an extension direction of the corrugated board web, which is orthogonal to the transfer direction, is referred to as a width direction, the center line side in the width direction of the corrugated board web is referred to as an inner side, and the opposite side thereto is referred to as an outer side.

In a case of being described as an upstream without a particular explanation, it means an upstream in the transfer direction, and in a case of being described as a downstream without a particular explanation, it means a downstream in the transfer direction.

The embodiments shown below are merely exemplification and there is no intention to exclude the application of various modifications or techniques which are not specified in the following embodiments. Each configuration of the following embodiments can be variously modified and implemented within a scope which does not departing from the gist thereof, and can be selected as necessary or can be combined appropriately.

1. Common Configuration of Each Embodiment

1-1. Overall Configuration of Corrugated Board Manufacturing System

A corrugated board manufacturing system according to each embodiment will be described with reference to FIG. 1.

The corrugated board manufacturing system is composed of a corrugated board manufacturing apparatus 1 and a production management device 2 which controls the corrugated board manufacturing apparatus 1.

The corrugated board manufacturing apparatus 1 is provided with only one slitter scorer (a slitter device) 15 which is always used. Specifically, the corrugated board manufacturing apparatus 1 includes, as main constituent devices, a single facer 11, a double facer 12, a rotary shear 13, a separation cutting device 14, the slitter scorer 15, a director device 16, an upper corrugated board cutoff device 17U, a lower corrugated board cutoff device 17D, a first stacker 18U, and a second stacker 18D.

The single facer 11 creates a single-faced corrugated board 22 by corrugating a medium 21 and bonding the corrugated medium 21 to a top liner 20, and the double facer 12 creates a corrugated board web 24 by bonding a bottom liner 23 to the single-faced corrugated board 22.

The rotary shear 13 cuts and removes the corrugated board web 24 for a period in which product quality is not stable shortly after the corrugated board manufacturing apparatus 1 is started.

The separation cutting device 14 forms a separation cutting line in advance in the corrugated board web 24 between an old order and a new order according to an order change. The separation cutting device 14 and the separation cutting line will be described in detail later.

The slitter scorer 15 creates a plurality of slitted webs 25 by cutting the corrugated board web 24 along the transfer direction or performing creasing line processing, and the director device 16 is for separating and distributing the plurality of slitted webs 25 which are conveyed, to the upper corrugated board cutoff device 17U or the lower corrugated board cutoff device 17D.

The upper corrugated board cutoff device 17U cuts a slitted web 25U distributed to the upper side, among the slitted webs 25, along the width direction, thereby making a corrugated board 26U, and the lower corrugated board cutoff device 17D cuts a slitted web 25D distributed to the lower side, among the slitted webs 25, along the width direction, thereby making a corrugated board 26D. In FIG. 1, for convenience, each of the slitted webs 25U and 25D is shown by a single line. However, this does not mean that each of the slitted webs 25U and 25D is one sheet. The number of each of the slitted webs 25U and 25D varies according to an order, and there is also a case where the slitted web is one sheet or there is also a case where the slitted webs are plural sheets.

The first stacker 18U and the second stacker 18D stack the corrugated boards 26U and 26D.

1-2. Configuration of Corrugated Board Web Cutting Device

The configurations of the corrugated board web cutting device, which are shared by the respective embodiments of the present invention, will be further described with reference to FIGS. 2A and 2B.

The corrugated board web cutting device is configured to include the separation cutting device 14, the slitter scorer 15, the director device 16, the upper corrugated board cutoff device 17U, and the lower corrugated board cutoff device 17D described above, and the production management device 2 (refer to FIG. 1). The production management device 2 configures a control device in the present invention.

The separation cutting device 14 is configured to include a jet nozzle 14*j* and a moving mechanism (not shown) which moves the jet nozzle 14*j* along the width direction, as shown by white arrows. The jet nozzle 14*j* jets a liquid toward the corrugated board web 24, as shown by a black arrow in FIG. 2B, and cuts the corrugated board web 24 by the jetted liquid.

The slitter scorer 15 is provided with various rolls for cutting the corrugated board web 24 along the transfer direction or performing creasing line processing. However, in FIGS. 2A and 2B, only the rolls relevant to the feature of the present invention, specifically, only a pressing roll 15*a* and a slitter knife 15*b* are shown, and a creasing line roll for performing the creasing line processing is omitted.

The pressing roll 15*a* and the slitter knife 15*b* are disposed to face each other with the corrugated board web 24 interposed therebetween to form a pair of upper and lower roll sets 15*c*, and a plurality of sets are provided side by side along the width direction. As shown in FIG. 2B, each roll set 15*c* enters any one state of a pressure contact state where the pressing roll 15*a* and the slitter knife 15*b* nip the corrugated board web 24, as shown by a solid line, and a separated state where the pressing roll 15*a* and the slitter knife 15*b* are separated from the corrugated board web 24, as shown by a two-dot chain line, by a moving mechanism (not shown). Further, each roll set 15*c* moves in the width direction and moves to a cutting position of the slitted web 25 corresponding to the order, by the operation of the moving mechanism.

Figure 2A:
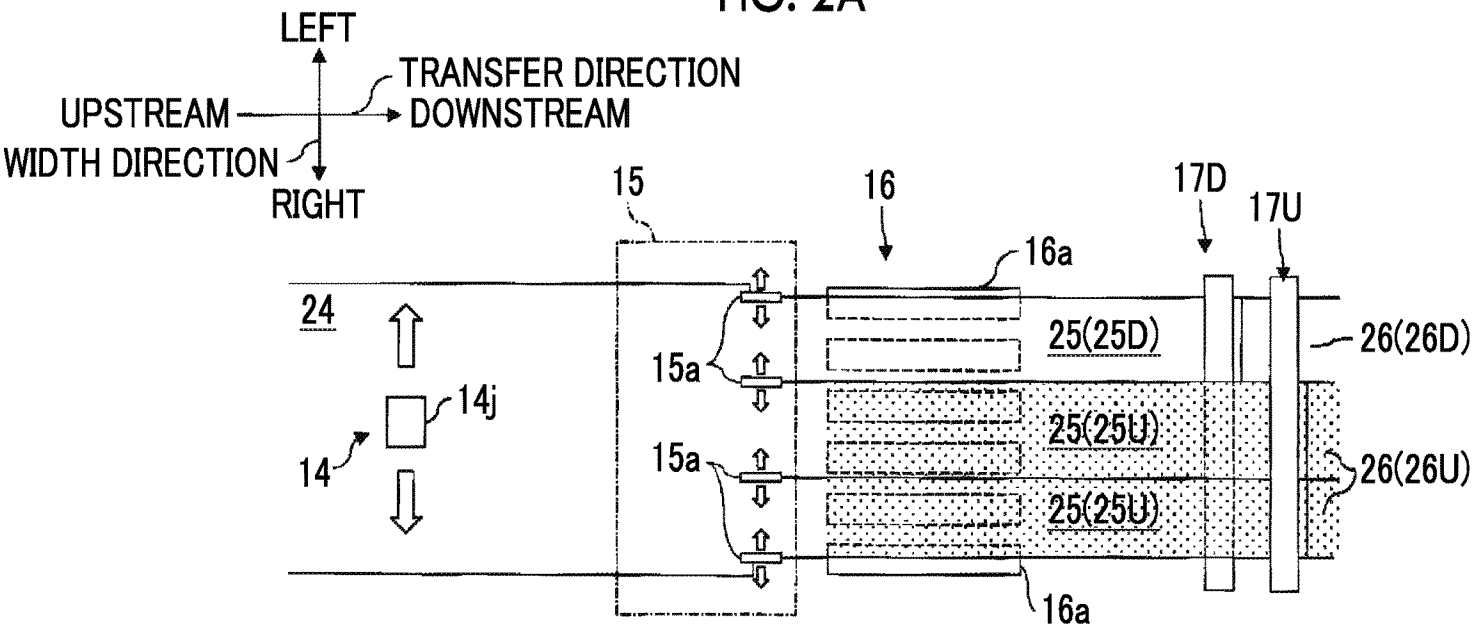
FIGS. 2A and 2B are schematic diagrams showing the configuration of a corrugated board web cutting device according to each embodiment of the present invention.

In this embodiment, as shown in FIG. 2A, the corrugated board web 24 is cut into, for example, three slitted webs 25 by the slitter scorer 15.

As necessary, cuts (not shown) are provided in both ends of the corrugated board web 24 along the width direction by edge shears (not shown) installed further on the upstream side than the slitter scorer 15. In this embodiment, the cuts are provided by the edge shears, and thus when the corrugated board web 24 is cut by the slitter scorer 15, both ends of the corrugated board web 24 are cut off as trim pieces.

The director device 16 is composed of a plurality of (in this embodiment, six) strip-shaped plates 16*a* which are disposed below the slitted web 25 and arranged in the width direction. Each of the plates 16*a* is configured to have a longitudinal direction directed in the transfer direction and be swingable in an up-down direction with an upstream end as the center, and is individually set to any one posture of a horizontal posture and an inclined posture inclined upward from the upstream toward the downstream, by a drive mechanism (not shown). The plate 16*a* guides the slitted web 25 to the lower corrugated board cutoff device 17D in the horizontal posture, and guides the slitted web 25 to the upper corrugated board cutoff device 17U in the inclined posture.

The posture of the plate 16*a* is controlled according to the order by the production management device 2, and in the example shown in FIG. 2A, the four plates on the right side are in the inclined posture, and the two plates on the left side are in the horizontal posture. In this way, as shown in FIG. 2A, two slitted webs 25 on the right side shown with halftone dots for convenience, among three slitted webs 25, are conveyed to the upper corrugated board cutoff device 17U, and one slitted web 25 on the left side is conveyed to the lower corrugated board cutoff device 17D.

Figure 2B:
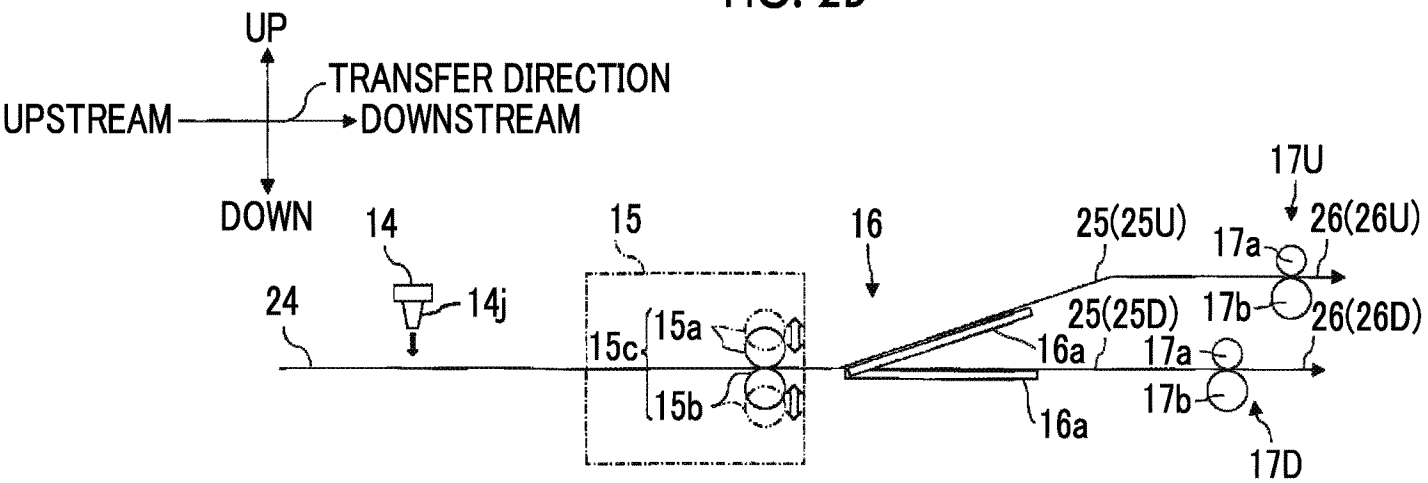

In FIGS. 2A and 2B, the upper corrugated board cutoff device 17U and the lower corrugated board cutoff device 17D are shown to be shifted in the transfer direction for convenience. However, the upper corrugated board cutoff device 17U and the lower corrugated board cutoff device 17D are disposed in two upper and lower stages, and the upper corrugated board cutoff device 17U and the lower corrugated board cutoff device 17D have the same configuration. Specifically, the upper corrugated board cutoff device 17U is configured to nip the slitted web 25U which is conveyed to the upper corrugated board cutoff device 17U, among the slitted webs 25, from above and below, and the lower corrugated board cutoff device 17D is configured to nip the slitted web 25U which is conveyed to the lower corrugated board cutoff device 17D, among the slitted webs 25, from above and below, and each of the upper corrugated board cutoff device 17U and the lower corrugated board cutoff device 17D is composed of an upper knife cylinder 17*a* and a lower knife cylinder 17*b* disposed in a pair. In FIG. 2A, the lower knife cylinder 17*b* is omitted.

Each of the upper knife cylinder 17*a* and the lower knife cylinder 17*b* is rotationally driven, and the slitted web 25U or 25D transferred between the upper knife cylinder 17*a* and the lower knife cylinder 17*b* is periodically nipped and cut by knifes (not shown) fixed to the respective peripheral surfaces of the upper knife cylinder 17*a* and the lower knife cylinder 17*b*. In this way, the corrugated boards 26U and 26D having a predetermined length are manufactured as final products. Further, the corrugated boards 26U and 26D having different lengths in the transfer direction can be simultaneously created by the upper corrugated board cutoff device 17U and the lower corrugated board cutoff device 17D.

2. First Embodiment

2-1. Cutting Operation of Corrugated Board Web Cutting Device

A corrugated board web cutting device according to a first embodiment of the present invention will be described with reference to FIG. 3.

Figure 3:
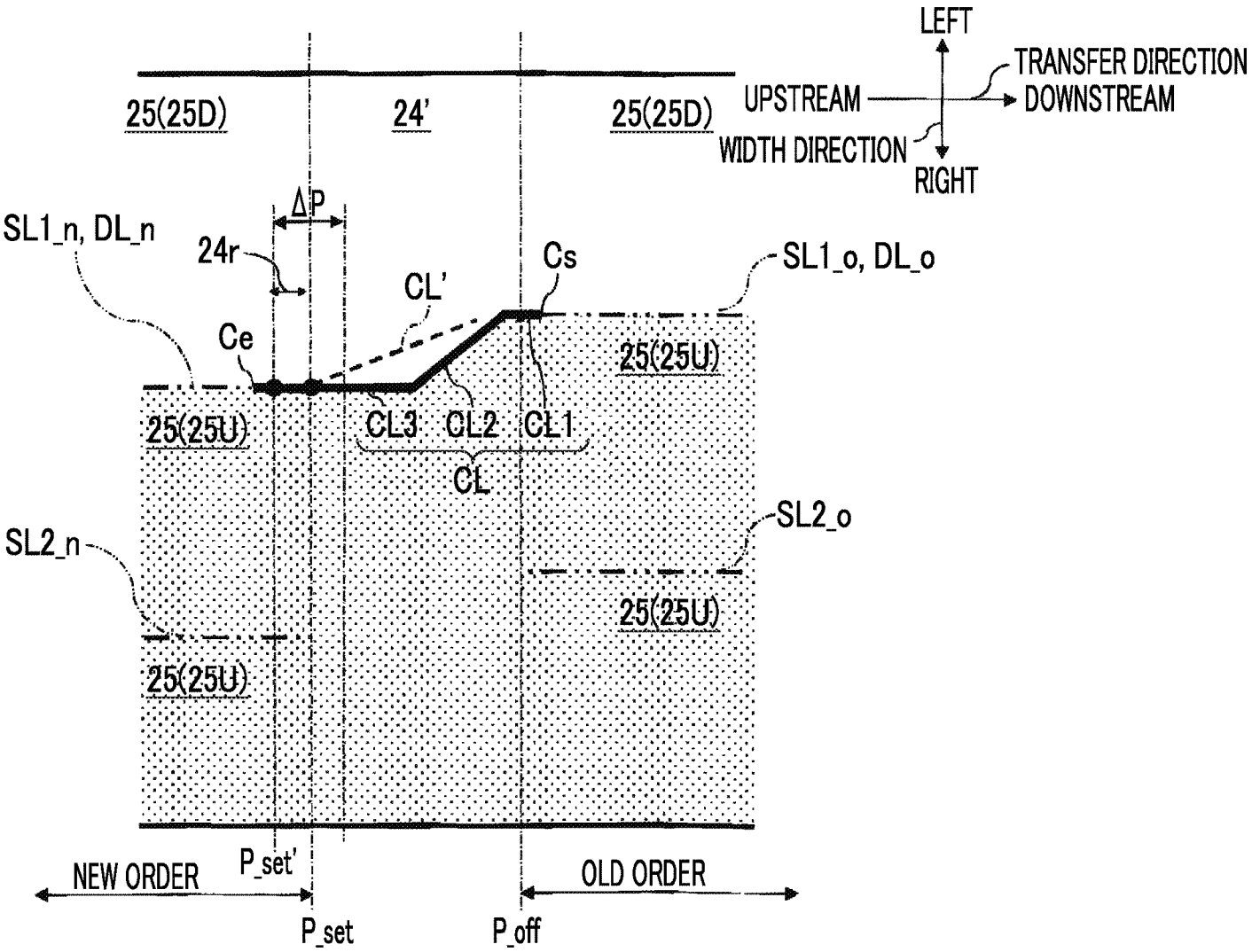
FIG. 3 is a schematic diagram for describing an operation of a corrugated board web cutting device according to a first embodiment of the present invention and is a plan view of a slitted web or a corrugated board web after the start of cutting.

FIG. 3 is a plan view of the corrugated board web after it has been cut by the slitter scorer 15. In FIG. 3, for convenience, a cutting line CL formed by the separation cutting device 14 is shown by a solid line, and cutting lines SL1_*o*, SL2_*o*, SL1_*n*, and SL2_*n* formed by the slitter scorer 15 are shown by a two-dot chain line. The cutting lines SL1_*o* and SL2_o are cutting lines corresponding to the old order, and the cutting lines SL1_n and SL2_n are cutting lines corresponding to the new order.

Further, in FIG. 3, the slitted web 25U which is conveyed to the upper corrugated board cutoff device 17U is shown with halftone dots for convenience. In the example shown in FIG. 3, the cutting lines SL1_n and SL1_o become separation cutting lines DL_n and DL_o of the new order and the old order, respectively. The separation cutting lines DL_n and DL_o particularly refer to cutting lines which become boundary lines between the slitted web 25U which is conveyed to the upper corrugated board cutoff device 17U and the slitted web 25D which is conveyed to the lower corrugated board cut-off device 17D.

If an order change command is output from the production management device 2 (refer to FIG. 1), the slitter scorer 15 acquires a position in the width direction corresponding to the new order and moves the roll sets 15c from the positions corresponding to the cutting lines SL1_o and SL2_o to the positions corresponding to the cutting lines SL1_n and SL2_n. In this way, the formation of the cutting lines SL1_n and SL2_n is started. More specifically, the respective roll sets 15c enter a state of being separated from the corrugated board web 24 at a point P_off, are then moved to the positions corresponding to the cutting lines SL1_n, SL2_n, and enter the pressure contact state at a point P_set to start the formation of the cutting lines SL1_n, SL2_n. Cutting is not performed by the slitter scorer 15 in a section between the point P_off and the point P_set, in other words, a section necessary for the movement of each roll set 15c of the slitter scorer 15. For this reason, each of the separation cutting lines DL_o and DL_n of the old order and the new order is discontinuous as is, and therefore, the separation cutting line CL is formed in advance by the separation cutting device 14 so as to connect the separation cutting lines DL_o and DL_n.

The separation cutting device 14 in the present invention will be described. The corrugated board manufacturing apparatus 1 is provided with only one slitter scorer 15, and therefore, as described above, compared to a case where two slitter scorers 15 are used alternately for each order, there is a case where an error ΔP occurs at the point P_set which is the start position of the separation cutting line DL_n, that is, the cutting line SL1_n of the new order. In a case where the point P_set is shifted to a point P_set' on the upstream side, if a cutting line CL' is formed by the separation cutting device 14 so as to be connected to the planned point P_set by pin points, as shown by a broken line, as in the related art, there is a concern that a problem may arise.

That is, in a case where the point P_set is shifted to the point P_set', the cutting line CL' is not connected to the point P_set', so that it cannot connect the separation cutting lines DL_o and DL_n, and an uncut portion 24r is generated in a corrugated board web 24' which becomes a waste sheet between the old order and the new order.

Therefore, in the present invention, the separation cutting line CL composed of cutting lines CL1, CL2, and CL3 which are continuous is formed by the separation cutting device 14 such that the uncut portion 24r is not generated even if the error ΔP occurs at the point P_set.

Specifically, if the separation cutting device 14 receives the order change command, the separation cutting device 14 starts cutting by nozzle injection from a position slightly further on the downstream side than the point P_off. In this way, the cutting line CL1 is formed along the transfer direction from a start position Cs in the corrugated board web 24' which advances in the transfer direction.

Next, the separation cutting device 14 which continues to execute the nozzle injection is moved along the width direction toward the separation cutting line DL_n further on the downstream side than the point P_set which is a planned cutting start position, and when the separation cutting device 14 reaches the position of the separation cutting line DL_n, the separation cutting device 14 stops the movement. In this way, the cutting line CL2 is formed obliquely to the front of the point P_set in the corrugated board web 24 which advances in the transfer direction.

Then, the separation cutting device 14 continues the nozzle injection for a predetermined time or by a predetermined distance even after the stop, thereby cutting the corrugated board web 24' which advances in the transfer direction, and as a result, the cutting line CL3 along the transfer direction is formed to an end position Ce further on the upstream side than the point P_set.

In this way, even if an error occurs at the point P_set in the transfer direction, the cutting line CL3 is formed so as to cover this error range, and therefore, the uncut portion 24r can be prevented from being generated between the separation cutting lines DL_o and DL_n of the old order and the new order.

The point P_off forming the upstream end of the separation cutting line DL_o of the old order is defined merely by separating each roll set 15c of the slitter scorer 15 from the corrugated board web 24, and therefore, compared to the point P_set, a position shift in the transfer direction is less. If this position shift can be ignored, the separation cutting line CL may be formed by the cutting lines CL2 and CL3 without forming the cutting line CL1 along the transfer direction.

2-2. Operation and Effect

According to the first embodiment of the present invention, even after the separation cutting device 14 reaches the same position in the width direction as the separation cutting line DL_n of the new order and stops, the cutting operation is continued for a predetermined time or by a predetermined cutting length, thereby forming the cutting line CL3 having a width (margin) in the transfer direction. In this way, even if the error ΔP occurs, in the transfer direction, at the point P_set which is the start position of the separation cutting line DL_n, this error range can be absorbed by the width (margin) of the cutting line CL3.

Therefore, the separation cutting lines DL_n and DL_o of the new order and the old order can be reliably connected to each other, and thus the slitted web 25U or 25D which is conveyed to the upper corrugated board cutoff device 17U or the lower corrugated board cutoff device 17D can be prevented from being torn or jammed up in a conveyance path.

3. Second Embodiment

3-1. Cutting Operation of Corrugated Board Web Cutting Device

Figure 4:
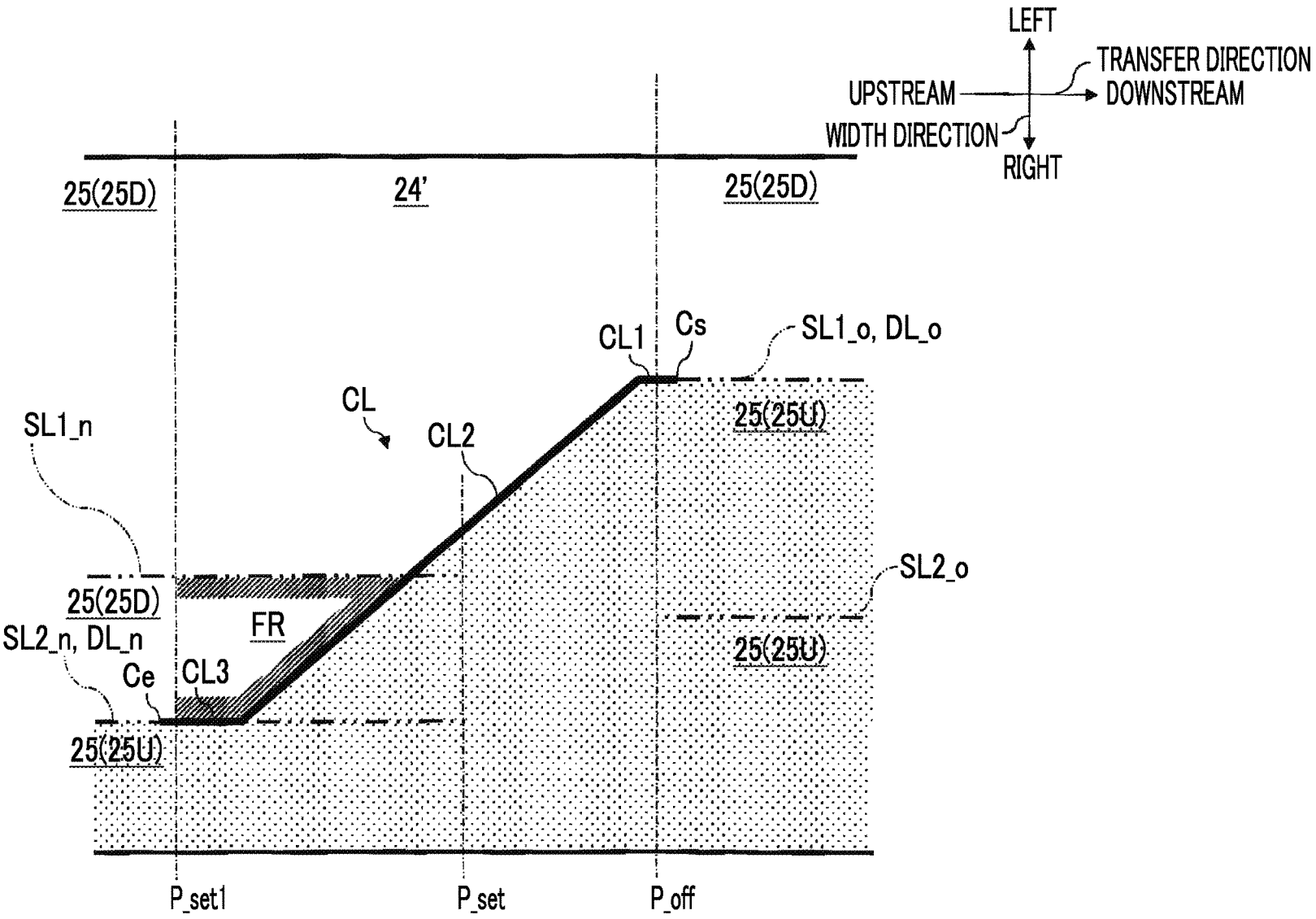
FIG. 4 is a schematic diagram for describing an operation of a corrugated board web cutting device according to a second embodiment of the present invention and is a plan view of a slitted web or a corrugated board web after the start of cutting.

A corrugated board web cutting device according to a second embodiment of the present invention will be described with reference to FIG. 4. FIG. 4 is a plan view of the corrugated board web after it has been cut by the slitter scorer 15. In FIG. 4, for convenience, the cutting line CL formed by the separation cutting device 14 is shown by a solid line, and the cutting lines SL1_o, SL2_o, SL1_n, and SL2_n formed by the slitter scorer 15 are shown by a two-dot chain line.

Further, in FIG. 4, the slitted web 25U which is conveyed to the upper corrugated board cutoff device 17U is shown with halftone dots for convenience. In the example shown in FIG. 4, the cutting lines SL2_*n* and SL1_*o* become the separation cutting lines DL_n and DL_o of the new order and the old order.

The same constituent elements as those in the first embodiment described above are denoted by the same reference numerals, and description thereof is omitted.

In the example shown in FIG. 4, due to a production schedule, the position in the width direction of the separation cutting line DL_n of the new order is greatly changed from the position in the width direction of the separation cutting line DL_o of the old order, and therefore, the amount of movement in the width direction of the separation cutting device 14 becomes large. As a result, the amount of movement in the width direction of each roll set 15*c* of the slitter scorer 15 from the cutting lines SL2_*o* and SL1_*o* of the old order to the cutting lines SL2_*n* and SL1_*n* of the new order becomes smaller than the amount of movement in the width direction of the separation cutting device 14.

For this reason, a movement period (a first period) Tγ which is required for formation of the separation cutting line CL becomes longer than a setting period (a second period) Ts1 for the new order of the slitter scorer 15, that is, a period which is required for each roll set 15*c* to move from the position of the old order to the position of the new order.

As a result, after each roll set 15*c* passes the point P_set where the movement to the position for the new order is completed, the separation cutting device 14 arrives at the same position in the width direction as the separation cutting line DL_n of the new order.

In such a case, the cutting lines SL1_*n* and SL2_*n* are formed from the downstream side of the separation cutting line CL, and thus cut intersecting the separation cutting line CL are formed on the new order side of the corrugated board web 24'. If such cuts are formed, a flap piece FR is formed in the corrugated board web 24', as shown to be surrounded by hatching, and the flap piece FR is caught, and thus there is a concern that jamming-up may occur in the director device 16.

Therefore, in a case where the movement period Tγ of the separation cutting device 14 becomes longer than the setting period Ts1 of the slitter scorer 15, the production management device 2 determines that there is a concern that the flap piece FR may be formed in the corrugated board web 24', and delays the start of the cutting operation of the slitter scorer 15 pertaining to the new order.

Specifically, before the production management device 2 acquires movement completion information indicating that the separation cutting device 14 has completed the movement for forming the separation cutting line CL, even if each roll set 15*c* of the slitter scorer 15 completes the movement to the cutting position pertaining to the new order at the point P_set, each roll set 15*c* enters a standby state where it is separated from the corrugated board web 24'. Then, the cutting by the slitter scorer 15 is started in an operation state where each roll set 15*c* is brought into pressure contact with the corrugated board web 24 at a point P_set1 at which the movement completion information of the separation cutting device 14 is acquired. That is, a period in which the slitter scorer 15 waits until the movement of the separation cutting device 14 is completed is provided, and if the separation cutting line CL is completed, the cutting by the slitter scorer 15 is started.

The other points are the same as those in the first embodiment, and therefore, description thereof is omitted.

3-2. Control Flow

A control flow of the second embodiment of the present invention will be described with reference to FIGS. 5 to 7. This control flow is executed by the production management device 2 for each order change. Further, the operations of the slitter scorer 15 and the separation cutting device 14 in this control flow are performed based on a control command of the production management device 2.

Figure 5:
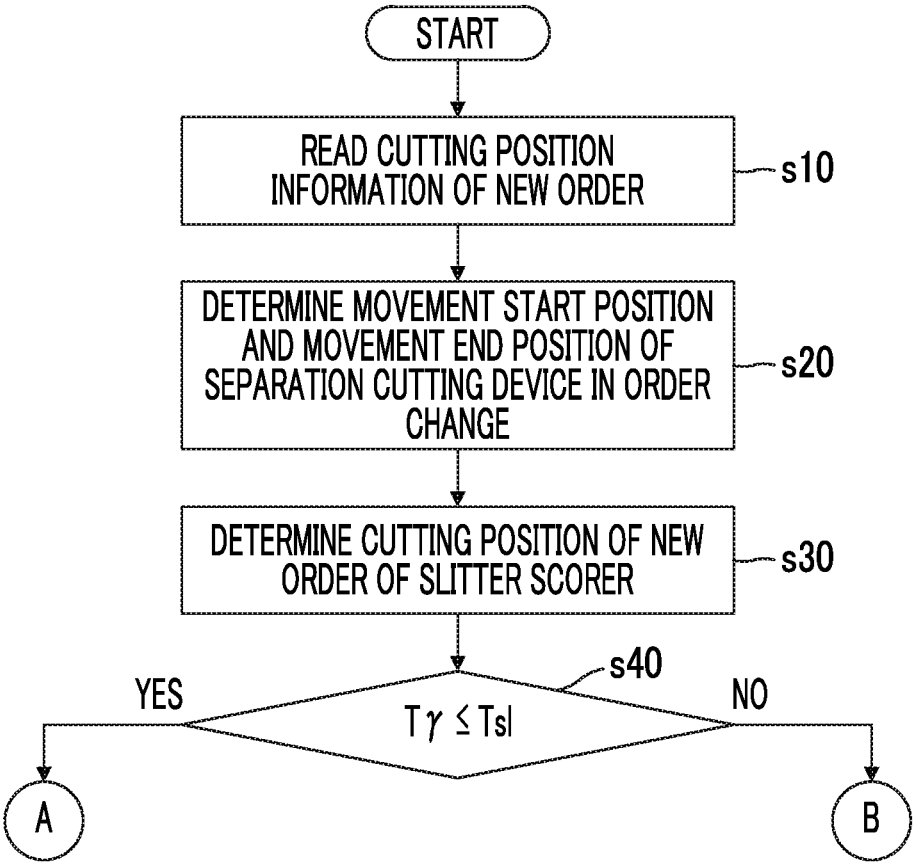
FIG. 5 is a schematic control flow for describing an example of control of the corrugated board web cutting device according to the second embodiment of the present invention.

As shown in FIG. 5, first, in Step s10, cutting position information of the new order is read from a higher-level production management system, and in Step S20, the movement start position and movement end position of the separation cutting device 14 are determined based on the cutting position information, and in Step s30, the cutting position of the new order of the slitter scorer 15 is determined. Then, in Step s40, the movement period Tγ of the separation cutting device 14 and the setting period Ts1 of the slitter scorer 15 are calculated based on the respective positions determined in Steps s20 and s30, and comparison of the movement period Tγ with the setting period Ts1 is performed. As a result, in a case where the movement period Tγ is equal to or less than the setting period Ts1, the routine proceeds to an A flow shown in FIG. 6, and in a case where the setting period Ts1 is longer than the movement period Tγ, the routine proceeds to a B flow shown in FIG. 7.

Figure 6:
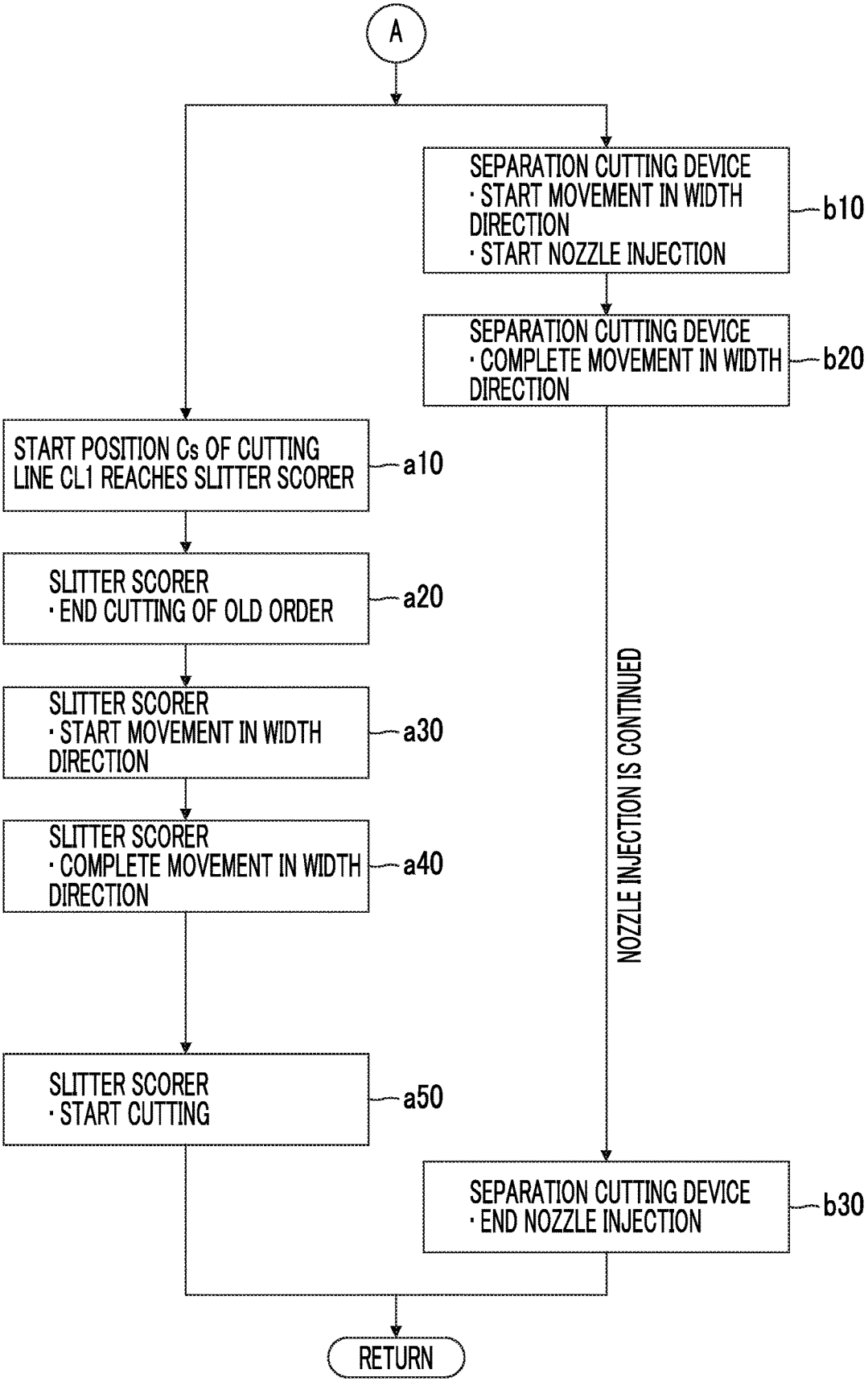
FIG. 6 is a schematic control flow for describing an example of control of the corrugated board web cutting device according to the second embodiment of the present invention.

In the A flow shown in FIG. 6, Steps a10 to a50 relating to the slitter scorer 15 and Steps b10 to b30 relating to the separation cutting device 14 proceed in parallel. In the B flow shown in FIG. 7, Steps a110 to a170 relating to the slitter scorer 15 and Steps b110 to b130 relating to the separation cutting device 14 proceed in parallel. The height of each step on the plane of the paper of FIGS. 6 and 7 schematically represents a timing at which the step is executed, and for example, in FIG. 6, Step b10 relating to the separation cutting device 14 is executed at a timing earlier than Step a10 relating to the slitter scorer 15.

The A flow and the B flow will be specifically described.

As shown in FIG. 6, in the A flow, first, in Step b10, the separation cutting device 14 starts the nozzle injection and the movement, and in Step b20, if the jet nozzle 14*j* advances to the position in the width direction of the separation cutting line DL_n of the new order, the separation cutting device 14 completes the movement. In this way, the cutting lines CL1 and CL2 are completed. The separation cutting device 14 continues the nozzle injection, and the formation of the cutting line CL3 is started according to the conveyance of the corrugated board web 24.

Subsequently, in Step a10, the start position Cs of the cutting line CL1 reaches the slitter scorer 15 on the downstream side according to the conveyance of the corrugated board web 24, and in Step a20, the slitter scorer 15 ends the cutting of the old order. Then, the roll set 15*c* of the slitter scorer 15 starts the movement in the width direction toward the position of the new order in Step a30, and if the movement is completed in Step a40, the cutting of the new order is started in Step a50.

Thereafter, in Step b30, if the separation cutting device 14 ends the nozzle injection and the cutting line CL3, eventually, the separation cutting line CL is completed, the routine returns. Then, in a case where there is an order change, the routine returns to Step s10 in FIG. 5.

Figure 7:
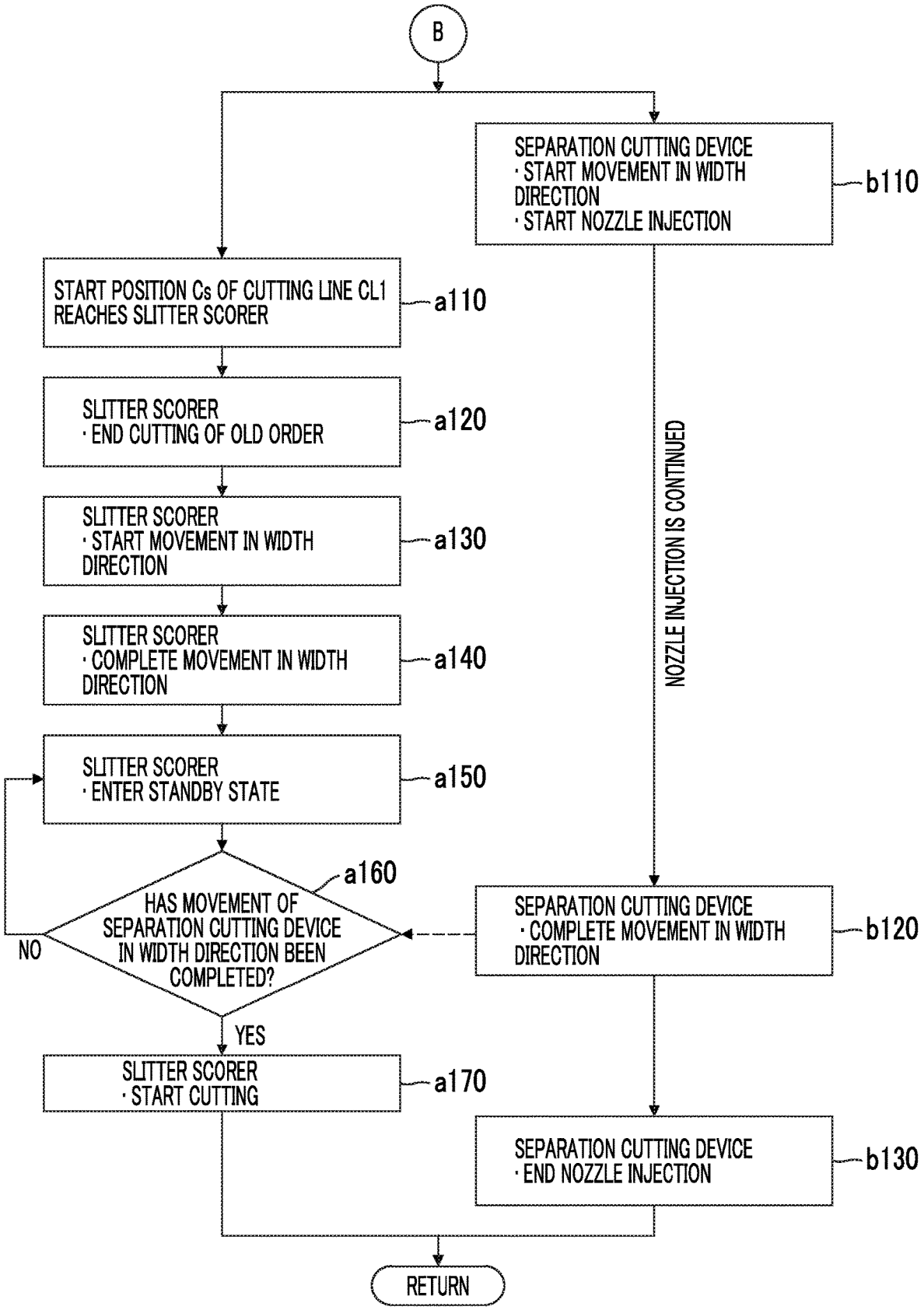
FIG. 7 is a schematic control flow for describing an example of control of the corrugated board web cutting device according to the second embodiment of the present invention.

As shown in FIG. 7, in the B flow, first, the separation cutting device 14 starts the nozzle injection and the movement in Step b110.

Subsequently, in Step a110, if the start position Cs of the cutting line CL1 reaches the slitter scorer 15, the slitter scorer 15 ends the cutting the old order in Step a120, and thereafter, the roll set 15*c* of the slitter scorer 15 starts the movement toward the position of the new order in Step a130 and the movement is completed in Step a140. Even if the movement of the roll set 15*c* is completed, the slitter scorer 15 does not immediately start the cutting of the new order, proceeds to Step a150, and enters a standby state.

Then, if the separation cutting device 14 reaches the separation cutting line DL_n to complete the movement in Step b120 and the cutting lines CL1 and CL2 are completed, the separation cutting device 14 outputs a movement completion signal. The separation cutting device 14 continues the nozzle injection even after the movement is completed, and starts the formation of the cutting line CL3.

In Step a160, whether or not the movement of the separation cutting device 14 has been completed is determined based on the movement completion signal. If the movement completion signal is output, the routine proceeds to Step a170, and the slitter scorer 15 starts the cutting of the new order and returns, and on the other hand, if the movement completion signal is not output, the routine returns to Step a150 and the slitter scorer 15 continues the standby state.

Then, after the slitter scorer 15 starts the cutting of the new order in Step a170, if the separation cutting device 14 ends the nozzle injection in Step b130 and the separation cutting line CL is completed, the routine returns. Then, in a case where there is an order change, the routine returns to Step s10 in FIG. 5.

3-3. Operation and Effect

According to the second embodiment of the present invention, even in a case where the position of the separation cutting line DL_n of the new order is greatly changed from the separation cutting line DL_o of the old order, the formation of the flap piece FR can be prevented, and thus it is possible to prevent occurrence of jamming-up due to the slitted web 25 being caught in the director device 16 on the downstream side of the slitter scorer 15 due to the presence of the flap piece FR.

4. Others (1) In each of the embodiments described above, the separation cutting device 14 is disposed on the upstream side of the slitter scorer 15. However, it is favorable if the separation cutting device 14 is disposed on the upstream side of the director device 16. Therefore, the separation cutting device 14 may be disposed on the downstream side of the slitter scorer 15 if it is the upstream side of the director device 16.

(2) In each of the embodiments described above, two cutoff devices are installed. However, three or more cutoff devices may be installed. In a case where three or more cutoff devices are installed, it is favorable if a plurality of separation cutting devices 14 for performing the cutting method in the embodiments described above are provided such that uncut portions are not left between the slitted webs which are conveyed to the cutoff devices.

(3) Further, in each of the embodiments described above, as the separation cutting device, the separation cutting device which cuts the corrugated board web 24 by nozzle injection is used. However, a cutter using a laser, or a knife capable of freely changing a cutting direction may be used in the separation cutting device.

REFERENCE SIGNS LIST

1: corrugated board manufacturing apparatus
2: production management device
14: separation cutting device
15: slitter scorer (slitter device)
15*a*: pressing roll
15*b*: slitter knife
15*c*: roll set
16: director device
17U: upper corrugated board cutoff device
17D: lower corrugated board cutoff device
24: corrugated board web
25, 25D, 25U: slitted web
CL: separation cutting line (cutting line)
DL_o, DL_n: separation cutting line
Tγ: movement period of separation cutting device 14 (first period)
Ts1: setting period of slitter scorer 15 (second period)

The invention claimed is:

1. A corrugated board web cutting device comprising:

one slitter device which forms cutting lines in a corrugated board web along a transfer direction to create a plurality of slitted webs;

a plurality of cutoff devices which cut the plurality of slitted webs along a width direction;

a director device which is disposed between the slitter device and the plurality of cutoff devices to separate the plurality of slitted webs cut by the slitter device and distribute the slitted webs to the plurality of cutoff devices;

a separation cutting device which is disposed further on the upstream side than the director device and forms separation cutting lines for separating the plurality of slitted webs in the director device, between the slitted web of a new order and the slitted web of an old order; and a control device which controls an operation of the separation cutting device so as to continue a cutting operation for a predetermined time or by a predetermined cutting length after a movement in the width direction is stopped at a position of the separation cutting line of the new order.

2. The corrugated board web cutting device according to claim 1, wherein the control device compares a first period which is required for the separation cutting device to move from the separation cutting line of the old order to the separation cutting line of the new order, with a second period which is required for the slitter device to be changed from setting for the old order to setting for the new order, and controls the slitter device such that the slitter device starts cutting after completion of a change to the setting for the new order, in a case where the first period is equal to or less than the second period.

3. The corrugated board web cutting device according to claim 1, wherein the control device compares a first period which is required for the separation cutting device to move from the separation cutting line of the old order to the separation cutting line of the new order, with a second period which is required for the slitter device to be changed from setting for the old order to setting for the new order, and controls the slitter device so as to start cutting by the slitter device after the separation cutting device moves to the separation cutting line of the new order, in a case where the first period exceeds the second period.

4. A corrugating machine comprising the corrugated board web cutting device according to claim 1.

5. A corrugating machine comprising the corrugated board web cutting device according to claim 2.

6. A corrugating machine comprising the corrugated board web cutting device according to claim 3.

* * * * *